US008672706B2

(12) United States Patent
Matsumoto et al.

(10) Patent No.: US 8,672,706 B2
(45) Date of Patent: Mar. 18, 2014

(54) CONNECTOR ASSEMBLY

(75) Inventors: Mitsuhiro Matsumoto, Makinohara (JP); Hajime Kato, Makinohara (JP); Kouichi Nakayama, Makinohara (JP); Tsuyoshi Mizushima, Makinohara (JP)

(73) Assignee: Yazaki Corporation, Tokyo (JP)

( * ) Notice: Subject to any disclaimer, the term of this patent is extended or adjusted under 35 U.S.C. 154(b) by 119 days.

(21) Appl. No.: 13/501,525

(22) PCT Filed: Oct. 28, 2010

(86) PCT No.: PCT/JP2010/069650

§ 371 (c)(1),
(2), (4) Date: Apr. 12, 2012

(87) PCT Pub. No.: WO2011/055768

PCT Pub. Date: May 12, 2011

(65) Prior Publication Data

US 2012/0208404 A1 Aug. 16, 2012

(30) Foreign Application Priority Data

Nov. 4, 2009 (JP) ..... 2009-252686

(51) Int. Cl.
*H01R 3/00* (2006.01)

(52) U.S. Cl.
USPC ..... 439/489

(58) Field of Classification Search
USPC ..... 439/489, 188, 189, 626, 235, 911, 439/646–652, 491, 727, 737, 791, 792; 200/50.1
See application file for complete search history.

(56) References Cited

U.S. PATENT DOCUMENTS

| | | | | |
|---|---|---|---|---|
| 5,486,119 | A * | 1/1996 | Nabeshima et al. | 439/489 |
| 6,056,592 | A | 5/2000 | Hashizawa et al. | |
| 6,287,139 | B1 * | 9/2001 | Seko et al. | 439/489 |
| 7,306,475 | B2 * | 12/2007 | Tsuruta | 439/364 |
| 7,572,150 | B2 * | 8/2009 | Matsuoka | 439/626 |
| 2012/0238147 | A1 * | 9/2012 | Matsumoto et al. | 439/660 |

FOREIGN PATENT DOCUMENTS

| | | |
|---|---|---|
| JP | 11-086959 A | 3/1999 |
| JP | 11-126661 A | 5/1999 |

OTHER PUBLICATIONS

International Search Report dated Dec. 7, 2010, issued for PCT/JP2010/069650.

* cited by examiner

*Primary Examiner* — R S Luebke
*Assistant Examiner* — Harshad Patel
(74) *Attorney, Agent, or Firm* — Edwards Wildman Palmer LLP

(57) ABSTRACT

The present invention provides a connector assembly having a small size and preventing a contact between a bolt fastener and a detection member. The connector assembly includes a connector having an inner chamber with an opening and a plurality of connector terminals, a connector receptacle having a plurality of connector receptacle terminals securable together with the connector terminals and a first detection member, and a cover for covering the opening and having a second detection member. When the opening of the inner chamber is covered with the cover, the first detection member and the second detection member are connected together and detect that the cover is covered. The first detection member is disposed between the adjacent connector receptacle terminals. An end surface of the first housing is positioned inwardly of the inner chamber with respect to a surface of a connector electrical contact portion.

2 Claims, 7 Drawing Sheets

CONNECTOR ASSEMBLY

TECHNICAL FIELD

The present invention relates to a connector assembly including a connector having a hole, a cover to cover the hole, and a connector receptacle for receiving the connector, more specifically, the cover and the connector receptacle each having a detection member to detect that the hole is covered with the cover.

RELATED ART

A vehicle such as an automobile includes a variety of electronic devices. A hybrid car or an electric car includes a three-phase current motor or an inverter to invert a direct current from a battery to an alternate current. The motor is connected with the inverter with an electrical wire through a connector assembly having a connector attached to a connector receptacle of the inverter (for example, JP H11-126661 A).

The connector assembly of JP H11-126661 A includes a connector having three connector terminals and a connector receptacle having three connector receptacle terminals secured together with the connector terminals by bolts. The connector receptacle has a receiving hole (opening) to receive the connector and the connector receptacle terminals. The connector receptacle has a hole communicating to the receiving hole to accept the bolts for securing the superposed terminals. Securing the terminals improves reliability of connection between the terminals. The connector assembly also includes a cover to cover the opening of the hole of the connector.

The connector assembly arranged between the motor and the inverter is subjected to a high voltage. It is essential to prevent an electrical shock to a worker when he involves maintenance. The connector assembly has thus a configuration such that a current flow between the secured terminals is only allowed when the cover covers the opening of the hole. The connector assembly has a first detection member disposed in the receiving hole of the connector receptacle and a second detection member upstanding from the cover and connectable with the second detection member. The first and the second detection member are an interlock connector.

The first detection member has a pair of first terminals and a first housing to receive the first terminals. The first terminals are connected to ECU with the electrical wires. The second detection member has a U-shaped second terminal and a second housing to receive the second terminal. When the cover covers the opening of the hole, both ends of the second terminal are connected to the first terminals, and the first and the second detection member are connected together.

Connection between the first and the second detection member forms a closed circuit with one of the first terminal, the second terminal, and the other of the first terminal in order. The ECU detects the cover covered in response to the closed circuit and allows the current flow between the terminals of the connector receptacle and the electronic devices of the inverter and the current flow between the secured terminals with the bolts. When the cover is uncovered, the first and the second detection member are disconnected each other and open the circuit. The ECU detects the opening uncovered and interrupts the current flow between the terminals of the connector receptacle and the electronic devices of the inverter, and interrupts (regulates) the current flow between the terminals.

The conventional connector assembly has the first detection member in the receiving hole of the connector receptacle.

The first detection member is disposed separately from the terminals to avoid hitting of a bolt fastener to the first detection member when the terminals are fastened with the bolts. This arrangement increases a size of the connector receptacle and also the size of the connector.

DISCLOSURE OF THE INVENTION

An object of the present invention is to provide a connector assembly having a small size and capable of preventing a hitting between a bolt fastener and terminals.

According to a first aspect of the present invention, the connector assembly includes a connector having an inner chamber with an opening and a plurality of connector terminals disposed in the inner chamber; a connector receptacle having a receiving hole for receiving the connector, a plurality of connector receptacle terminals disposed in the receiving hole communicating with the inner chamber and securable with bolts together with the connector terminals through the inner chamber, and a first detection member disposed between the adjacent connector receptacle terminals; a cover for covering the opening of the chamber of the connector and having a second detection member connectable to the first detection member, wherein when the opening of the inner chamber of the connector is covered with the cover, the first detection member and the second detection member are connected to allow current flow between the connector terminals and the connector receptacle terminals screwed together, and a portion, which is most adjacent to the opening of the inner chamber, of the first detection member is positioned inwardly of the opening with respect to a surface, which is most adjacent to the opening of the inner chamber, of the connector terminals.

Preferably, the first detection member includes a first terminal connectable to the second detection member and a first housing for receiving the first terminal, and the portion, which is most adjacent to the opening of the inner chamber, of the first detection member is an end surface of the first housing.

BEST MODE FOR CARRYING OUT THE INVENTION

Figure 1:
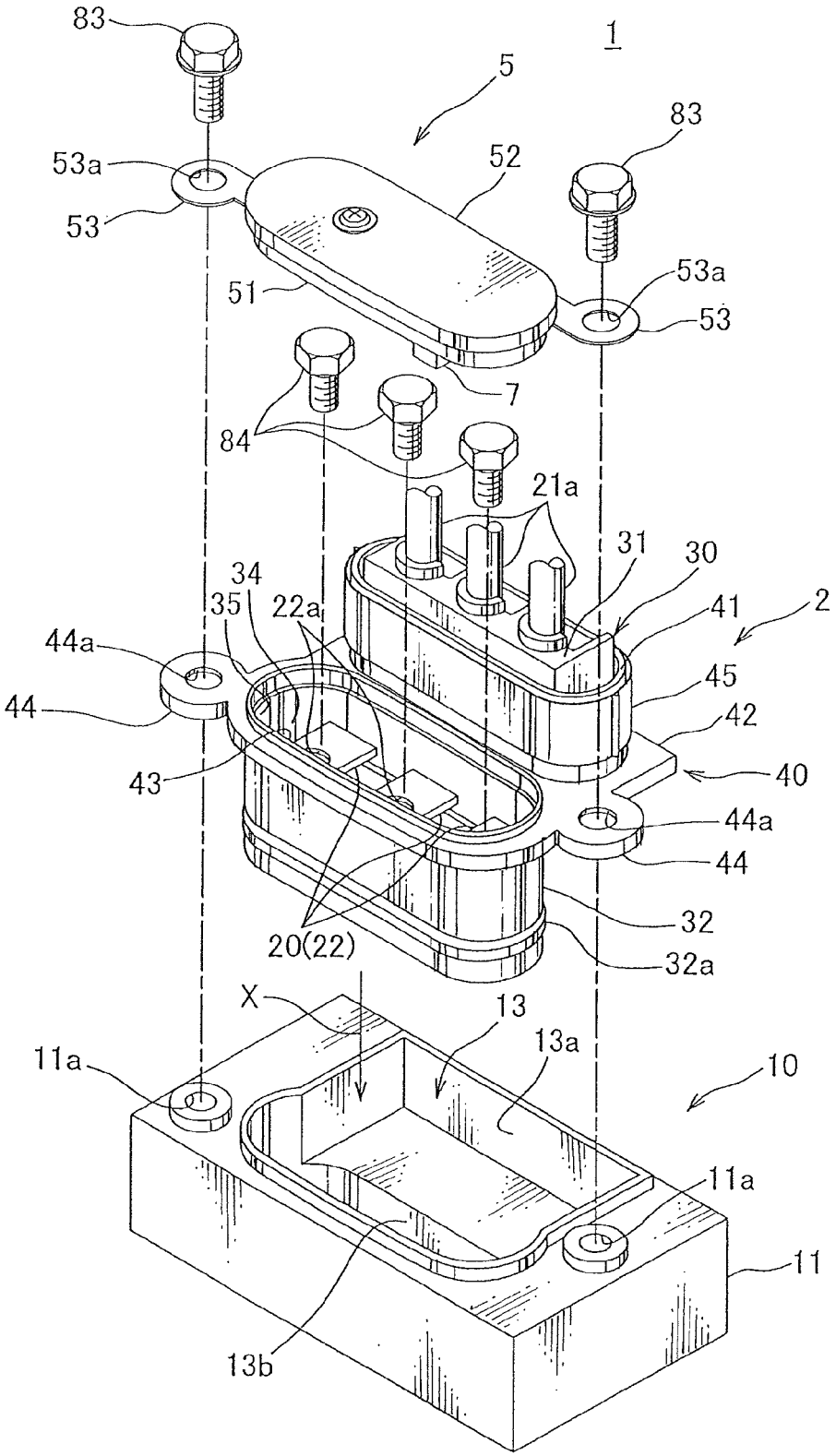
FIG. 1 is an exploded perspective view of one embodiment of a connector assembly of the present invention.

FIGS. 1-7 illustrate one embodiment of a connector assembly 1 of the present invention. The connector assembly 1 of the present invention is utilized for attaching a connector 2, which is connected to a three-phase motor mounted on a hybrid vehicle or electric vehicle, to a connector receptacle 10 of an inverter. Referring to FIG. 1, the connector assembly 1 includes the connector receptacle 10, the connector 2, and a cover 5.

The connector receptacle 10 is disposed on a surface of the inverter and has a shielding shell 11, a connector receptacle terminal 12 (for example FIG. 3, hereafter referred to cr-terminal), and a housing (not shown). The shielding shell 11 is made of a conductive metal and box-shaped, and has a receiving hole 13 on a surface thereof for receiving the connector 2.

The receiving hole 13 has a large size portion 13*a* and a small size portion 13*b*. The large size portion 13*a* is disposed adjacent to a surface of the shielding shell 11 and has a periphery substantially similar to an outer shape of the central portion (flange 42) of the connector 2, and the small size portion 13*b* is disposed inward of the large size portion 13*a* and has a periphery substantially similar to an outer shape of an end portion (hood 32) of the connector 2. A pair of bolt insertion holes 11*a* are disposed at outer edge portions of the receiving hole 13 for fastening the connector 2.

The cr-terminal 12 is made with press-forming of a sheet metal. The connector receptacle 10 has a plurality of the cr-terminals 12 (three in the embodiment). The cr-terminals 12 each have an instrument connection portion (not shown) and an connector receptacle electrical contact portion 14 (hereafter referred to cr-electrical contact portion). Each instrument connection portion is disposed one end of each cr-terminal 12 and is connected to an electric component of the inverter.

Figure 3:
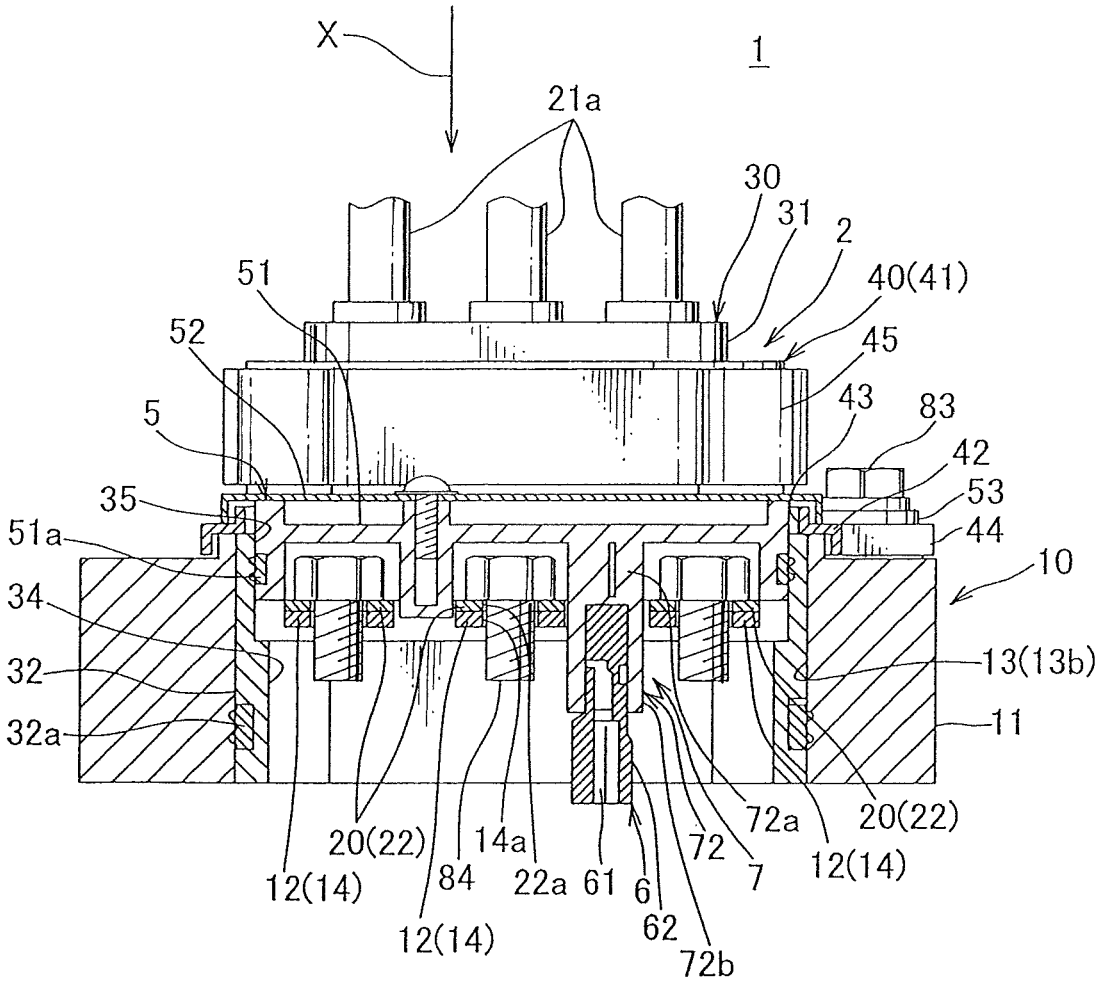
FIG. 3 is a sectional view taken along of FIG. 2.

The cr-electrical contact portions 14 are disposed on the other sides of the cr-terminals 12 and are formed in a plate shape (FIG. 3). Each cr-electrical contact portion 14 has a cr-bolt insertion hole 14*a* at the central portion thereof. The cr-electrical contact portions 14 have flat surfaces perpendicular to an insertion direction X of the connector 2 and are separated in flush one another.

The cr-electrical contact portions 14 are disposed in the small size portion 13*b* of the receiving hole 13. When the connector 2 is attached to the connector receptacle 10, the cr-electrical contact portions 14 are positioned in an inner chamber 34 of the hood 32. The cr-electrical contact portions 14 are fastened together with connector terminals 20, referred to c-terminal, of the connector 2 with bolts. The housing is made of a synthetic resin and one part of the respective cr-terminals 12 is embedded therein so that the instrument connection portions are positioned in a lower portion of the housing and the cr-electrical contact portions 14 are positioned in an upper portion of the housing as shown in FIG. 3.

The connector 2 is a shielded connector and includes the plurality of the c-terminals 20, a connector housing 30, a shielding shell 40 and a shielding ring 45.

The c-terminals 20 are press-formed with the metal sheet and disposed in the connector 2 (three in the embodiment). The c-terminals 20 are substantially L-shaped and each includes a connector electrical wire connection portion 21 (c-electrical wire connection portion) and a connector electrical contact portion 22 (c-electrical contact portion). Each c-electrical wire connection portion 21 is disposed on one side of the associated c-terminal 20 and connected to an electrical wire 21*a* having a conductive core wire and an insulation sheath covering the core wire.

Each c-electrical contact portion 22 has a flat plate and is disposed on the other side of the c-terminal 20. The c-electrical contact portion 22 has a connector bolt insertion hole 22*a* (c-bolt insertion hole) at the central portion thereof. The electrical contact portions 22 have flat surfaces perpendicular to the insertion direction X of the connector 2 and are separated in flush one another.

The c-electrical contact portions 22 are superposed on the cr-electrical contact portions 14 of the terminals 12 of the connector receptacle 10 and fastened together with the bolts. The fastening together of the electrical contact portions 22 and 14 improves reliability of connection between the terminals 20 and 12. The electrical contact portions 22 and 14 thus correspond to a superposed portion of the terminals 20 and 12.

Figure 4:
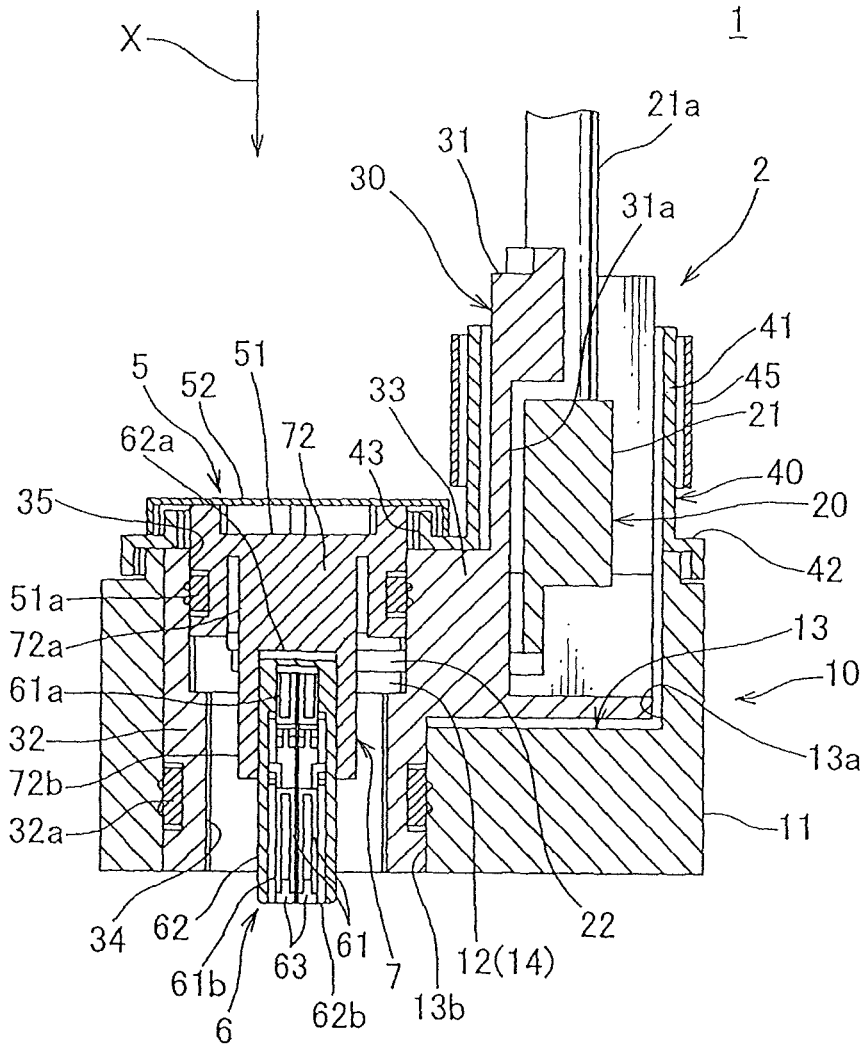
FIG. 4 is a sectional view taken along IV-IV of FIG. 2.

Referring to FIG. 4, the connector housing 30 is made of an insulation synthetic resin and includes a housing main body 31, the hood 32, and a link portion 33 connecting between the housing main body 31 and the hood 32.

The housing main body 31 has a flat box shape and includes three terminal chambers 31*a* to receive the c-electrical wire connection portions 21 of the c-terminals 20. FIG. 4 shows one of the terminal chambers 31*a*. The terminal chambers 31*a* are straight holes and disposed separately parallel each other from the same flat plane surface.

The hood 32 has a column shape and has the central axis, the vertical direction in FIG. 4, parallel to the longitudinal direction of the terminal chambers 31*a* and is connected to the housing main body 31 with the link portion 33. The c-electrical contact portions 22 of the c-terminals 20 project in the hood 32. The hood 32 has a sealing member 32*a* at an outer periphery thereof to intimately contact an inner surface of the small size portion 13*b* of the receiving hole 13 and keep watertight between the connector 2 and the connector receptacle 10.

The link portion 33 has a box shape and interconnects the housing main body 31 and the hood 32 with a surface of the hood 32 and a surface of the housing main body 31. The central portions of the c-terminals 20 are separately embedded in the link portion 33 to keep insulation one another.

Referring to FIG. 1, the shielding shell 40 is made of a conductive metal and integrally includes a column portion 41, which is disposed around the housing main body 31, and a flat-shaped flange 42 connected to the column portion 41 and facing end surfaces of the hood 32 and the link portion 33. The flange 42 has a size larger than the plane-viewed size of the receiving hole 13. The flange 42 has a hole 43 formed on the hood 32 to exteriorly expose the inner chamber 34 of the hood 32. The flange 42 has a pair of fastening pieces 44 with bolt insertion holes 44*a* at the periphery thereof.

The shielding ring 45 is made of a conductive metal and has an annular shape. The shielding ring 45 is disposed around the column portion 41 of the shielding shell 40, and crimped and attached to the column portion 41. The shielding ring 45 and the column portion 41 hold an end portion of a seal member (not shown) such as braided wires covering the electrical wires 21*a*.

The connector 2 described above is inserted into the receiving hole 13 of the connector receptacle 10 along the direction of X, that is the longitudinal direction of the terminal chamber 31*a*, indicated in FIG. 1. When the connector 2 is received in the receiving hole 13, the outer periphery of the flange 42 is superposed on the outer periphery of the receiving hole 13 and the bolt insertion holes 44*a* of the connector 2 and the bolt insertion holes 11*a* of the connector receptacle 10 are aligned one another. The connector 2 is fastened to the connector receptacle 10 together with the cover 5 with bolts 83 screwed in the bolt insertion holes 44*a* and 11*a*.

Figure 6:
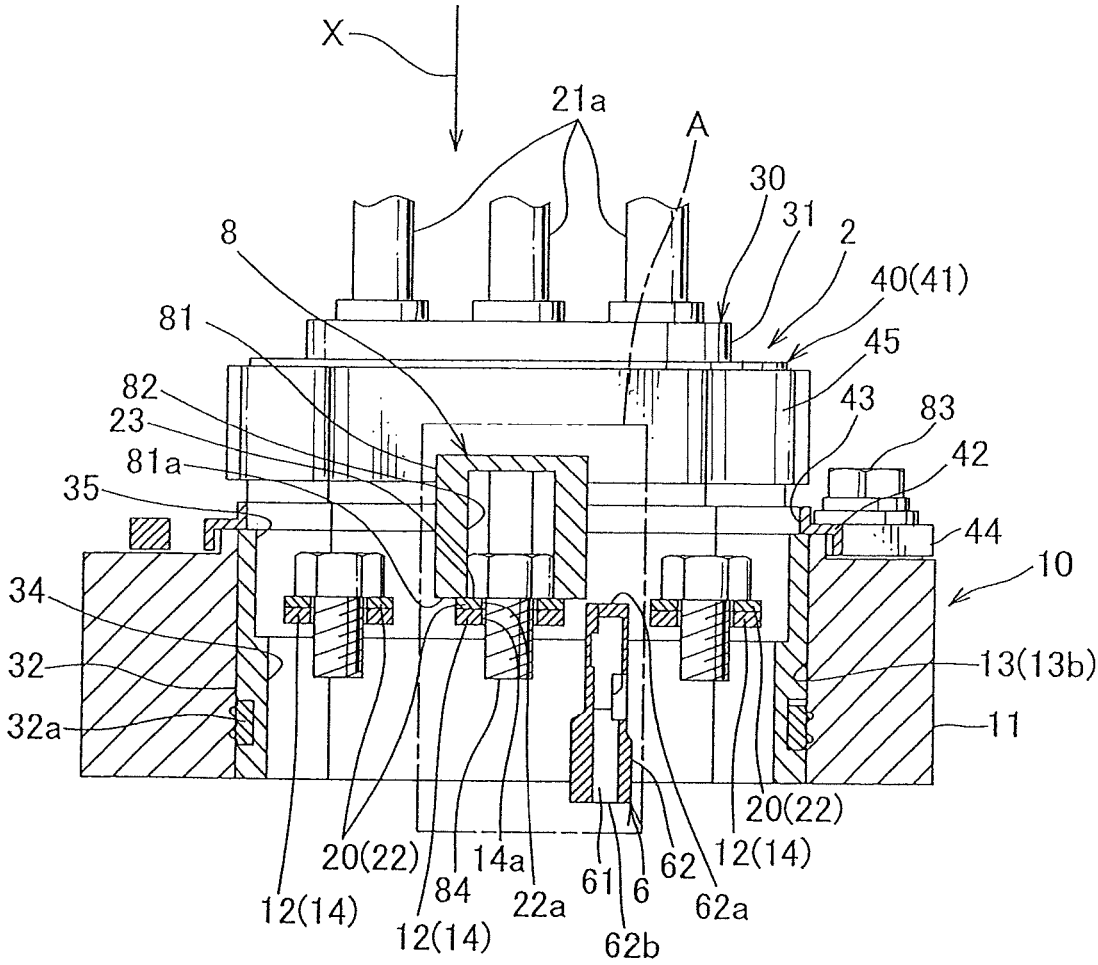
FIG. 6 is a sectional view taken along VI-VI of FIG. 5.

Referring to FIG. 6, when the connector 2 is received in the receiving hole 13, the inner chamber 34 of the hood 32 communicates the receiving hole 13 and the c-electrical contact portions 22 of the c-terminals 20 of the connector 2 contact the cr-electrical contact portions 14 of the cr-terminals 12 of the connector receptacle 10. The c-bolt insertion holes 22*a* and the cr-bolt insertion holes 14*a* are aligned one another to accept bolts 84 screwed from an opening 35 for fastening the c-electrical contact portions 22 and the cr-electrical contact portions 14 together.

Figure 5:
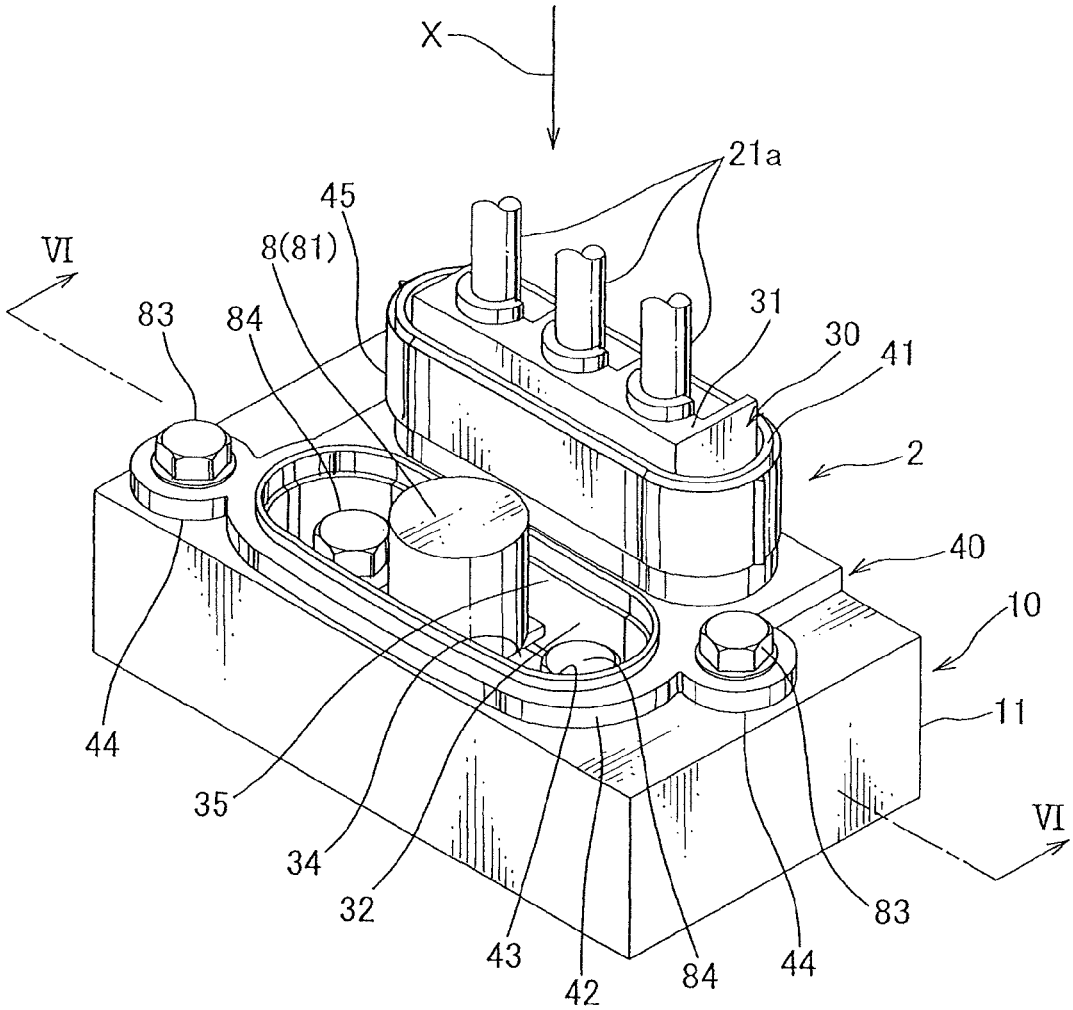
FIG. 5 is a perspective view showing that the cover is uncovered from the connector receptacle.
Figure 7:
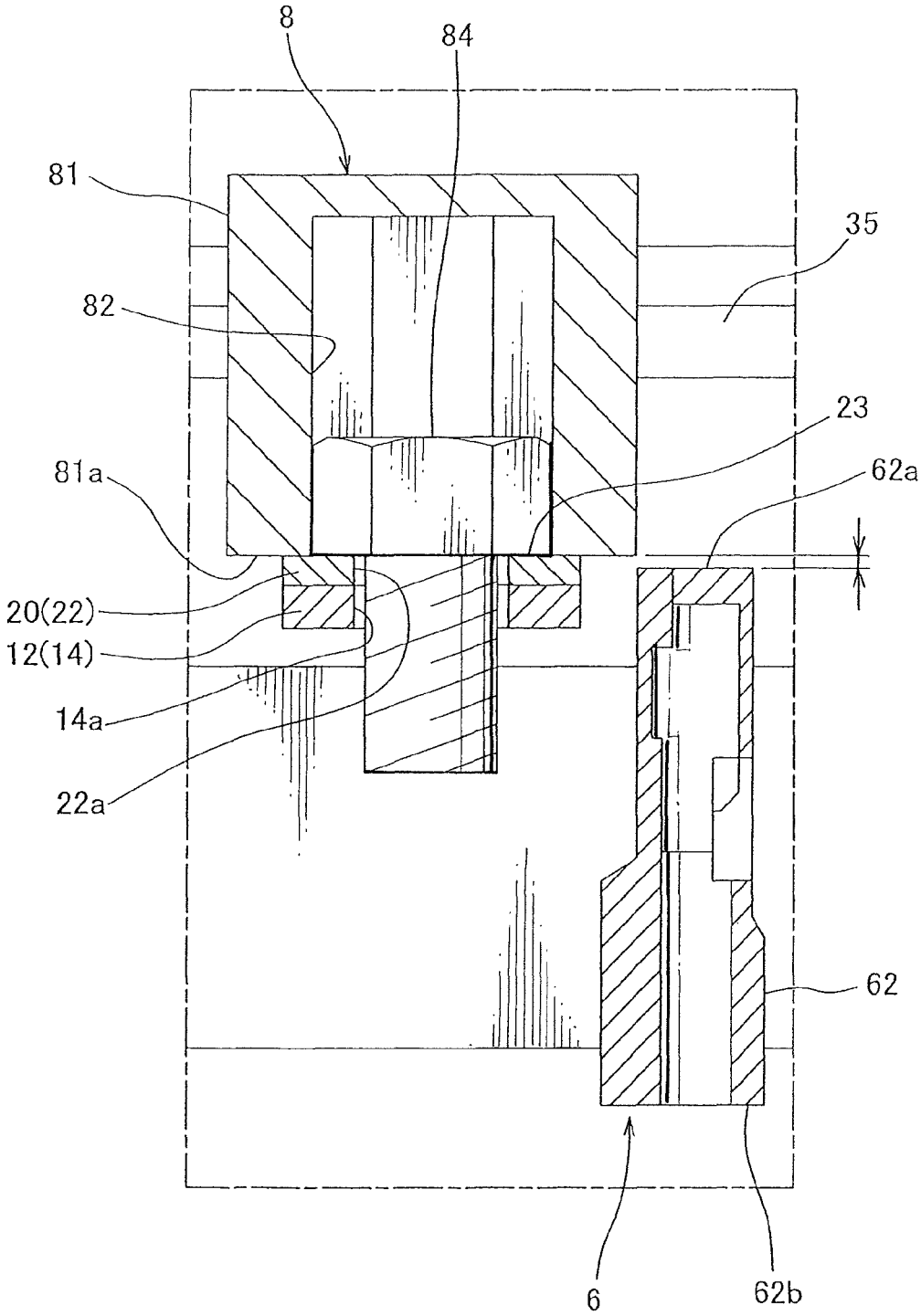
FIG. 7 is an enlarged sectional view of a part A of FIG. 6.

These bolts are fastened with a conventional electric or air type fastener 8. FIGS. 5-7 show only an end portion thereof. The end portion of the fastener 8 has a columnar-shaped socket portion 81 rotatable about its own central axis. The socket portion 81 has a bolt-supporting hole 82 (FIG. 6) with respect to an end surface 81*a*.

The bolt-supporting hole 82 has a size slightly larger than that of heads of the bolts 84 to position each bolt 84 therein. The bolts 84 are fastened with rotation of the socket portion 81. It is noted that the end surface 81*a* of the socket portion 81 contacts a surface 23 of the associated c-electrical contact portion 22 of the c-terminal 20 as shown in FIG. 7. The fastener 8 may also be a manual type.

The cover 5 has a cover main body 51 made of an insulation synthetic resin and a shielding portion 52 made of a conductive metal. The cover main body 51 and the shielding portion 52 are fixed together with a bolt. The cover main body 51 has a thick plate shape and is insertable into the hood 32. The cover main body 51 has a sealing member 51*a* at a periphery thereof to keep the inner chamber 34 of the hood 32 watertight.

The shielding portion 52 is formed in a plate shape and has a size slightly larger than that of the hole 43 of the shielding shell 40. The shielding portion 52 has a pair of fastening pieces 53 with bolt insertion holes 53*a* at a periphery thereof.

When the cover main body 51 is positioned over the opening 35, the cover main body 51 is fitted in the hood 32 and the periphery of the shielding portion 52 is placed on the periphery of the hole 43 of the shielding shell 40 so that the hole 43 or the opening 35 is covered. The cover 5, the connector 2 and the connector receptacle 10 are secured together with the bolts 83 screwed through the bolt insertion holes 53*a*, 44*a* and 11*a*.

Referring to FIGS. 3 and 4, the connector assembly 1 includes a first detection member 6 disposed on the connector receptacle 10, and a second detection member 7 disposed on the cover 5 and capable of being connected with the first detection member 6. The first and the second detection member 6 and 7 are an interlock connector.

Referring to FIG. 4, the first detection member 6 includes a pair of first terminals 61 made of a press-formed conductive metal plate and a first housing 62. Each first terminal 61 is a female type terminal and includes an electrical contact portion 61*a*, which is connected with a second terminal of the second detection member 7, and an electrical connection portion 61*b*, which is connected with an electrical wire (not shown) of ECU (not shown).

The first housing 62 is made of an insulation synthetic resin and has a box shape. The first housing 62 is connected with a housing (not shown) of the connector receptacle 10 in the receiving hole 13 and upstanding toward the opening of the receiving hole 13. The first housing 62 is positioned inside of the inner chamber 34 of the hood 32 when the connector 2 is connected to the connector receptacle 10. The first housing 62 includes two terminal chambers 63 to receive the first terminals 61.

The terminal chambers 63 have a straight hole and extend toward the insertion direction X of the connector 2. The terminal chambers 63 each have one opening at one end surface 62*a* of the receiving hole 13 and another opening at the other end surface 62*b* of the receiving hole 13. The terminal chambers 63 each receive the first terminal 61 so that the one end surface 62*a* of the first housing 62 faces the electrical contact portion 61*a* of the first terminal 61 and the other end surface 62*b* of the first housing 62 faces the electrical connection portion 21 of the first terminal 61.

Referring to FIG. 6, the first detection member 6 is disposed between the cr-terminals 12. The first detection member 6 is positioned inwardly with respect to the inner chamber 34 (receiving hole 13) compared to the conventional one. Referring to FIGS. 6 and 7, the end surface 62*a*, which faces the opening 35 of the hood 32, of the first housing is positioned inwardly of the inner chamber 34 with respect to the surface 23 of the c-electrical contact portions 14 of the c-terminals 20.

Therefore the end surface 81*a* of the fastener 8 is positioned above the end surface 62*a* of the housing 62 when the bolts are fastened. This arrangement prevents contact between the fastener 8 and the first detection member 6 when the electrical contact portions 21, 14 are fastened together.

Referring to FIG. 4, the second detection member 7 includes a second terminal (not shown) and a second housing 72. The second terminal is made of a conductive metal and has a U-shape. Both end portions of the second terminal are inserted in the electrical contact portions 61*a* of the first terminals 61 and electrically connected to the first terminals 61.

The second housing 72 is made of an insulation synthetic resin. The second housing 72 is upstanding from the shielding portion 52 toward the hood 32 and is fitted into the first housing 62 when the cover 5 covers the opening 35. The second housing 72 integrally has a main body 72*a* connected to the cover main body 51 and embedding the middle portion of the second terminal, and a hood 72*b* connected to the main body 72*a* and receiving the both end portions of the second terminal. The second terminal received in the second housing 72 extends in the longitudinal direction of the first detection member 6.

When the opening 35 is covered with the cover 5, the first detection member 6 is positioned inside of the second detection member 7 and the first terminals 61 and the both end portions of the second terminal are connected together as shown in FIGS. 3-4.

Connection between the first detection member 6 and the second detection member 7 forms a closed circuitry with one of the first terminals 61, the second terminal, and the other of the first terminals 61 in order. The ECU connected to the first terminals 61 then assures that the opening 35 is covered. The cr-terminals 12 and the electrical components of the inverter are electrically closed, and the c-terminals 20 and the cr-terminals 12 fastened with the bolts are subjected to current flow.

When the cover 5 is detached from the hood 32, the electrical connection between the first detection member 6 and the second detection member 7 is opened and the circuitry of the first and the second terminal is opened. The ECU detects the opening 35 uncovered and the circuitry between the first and the second terminal opened so that the current flow between the c-terminals 20 and the cr-terminals 12 are stopped (regulated).

The connector assembly 1 is assembled in the following manner. The connector 2 is inserted into the receiving hole 13 of the connector receptacle 10 in the direction X indicated in FIG. 1. The periphery of the flange 42 of the shielding shell 40 is superposed on the periphery of the receiving hole 12, and the bolt insertion holes 44*a* and 11*a* of the connector 2 and the connector receptacle 10 are aligned together.

The c-electrical contact portions 22 of the c-terminals 20 of the connector 2 and the cr-electrical contact portions 14 of the cr-terminals 12 of the connector receptacle 10 are overlapped one another in the hood 32. The bolts 84 are then screwed into the c-bolt insertion holes 22*a* and the cr-bolt insertion holes

14*a* with the fastener 8 to fasten the c-electrical contact portions 22 and the cr-electrical contact portions 14.

The cover 5 is then attached to the connector 2 (connector receptacle 10) to cover the hole 43 or the opening 35 of the shielding shell 40. The cover main body 51 is then inserted into the inner chamber 34 of the hood 32, the periphery of the shielding portion 52 is superposed on the periphery of the hole 43, and the opening 35 is covered with the cover 5.

Figure 2:
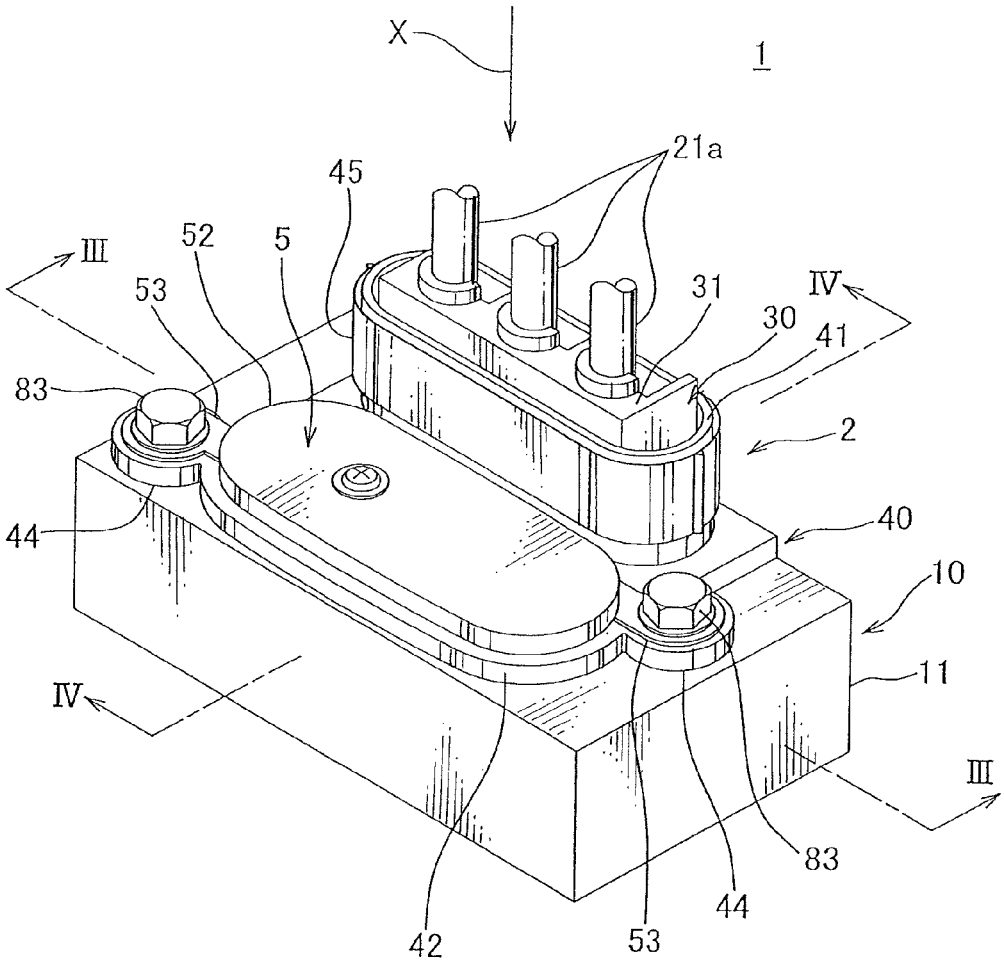
FIG. 2 is a perspective view showing that a connector and a cover are attached to a connector receptacle of the embodiment.

The cover 5, the connector 2 and the connector receptacle 10 are fastened with the fastener 8 by means of the bolts screwed in the bolt insertion holes 53*a*, 44*a*, 11*a* as shown in FIG. 2.

When the cover 5 is attached to the connector 2 and the first detection member 6 and the second detection member 7 are connected to one another, the ECU detects the opening 35 covered with cover 5 and allows the current flow between the c-terminals 20 and the cr-terminals 12. When the cover 5 is opened for maintenance, the terminals 20, 12 are exposed outside. The ECU detects the opening 35 uncovered with disconnection between the first detection member 6 and the second detection member 7. Electrical disconnection between the c-terminals 20 and the cr-terminals 12 prevents electrical shock.

When the connector 2 is attached to the connector receptacle 10, an electrical noise leaking from the electrical wires 21*a* is ground to the shielding member of the electrical wires 21*a*, the shielding shell 40 and the shielding shell 11 in order. The electrical noise leaking from the terminals 20, 12 is ground to the shielding portion 52, the shielding shell 40 and the shielding shell 11 (receptacle portion) in order.

The arrangement of the first detection member 6 adjacent and between the cr-terminals 12 minimizes the connector receptacle 10 and the connector 2. The end surface 62*a* of the first housing 62 of the first detection member 6 is positioned inwardly of the inner chamber 34 with respect to the surface 23 of the c-terminals 20 of the connector 2. This arrangement prevents contact between the first detection member 6 and the fastener 8, and minimizes the connector receptacle 10 and the connector 2 without requirement of a wide spacing between the c-terminals 12.

The c-terminals 20 and the cr-terminals 12 are secured together with the bolts through the inner chamber 34 of the connector 2 in the embodiment. It is appreciated that the c-terminals 20 and the cr-terminals 12 are secured together with the bolts screwed through a hole disposed on the connector receptacle and communicating with the receiving hole 13 (refer to JP H11-126661 A). The connector 2 connected to the motor is attached to the connector receptacle 10 in the embodiment. It is appreciated that the connector 2 connected to the electronic devices other than the motor may be attached to the connector receptacle 10 other than the inverter.

The embodiments described above are only exemplary and not limited thereto. Any modification thereof is within the scope of the invention.

INDUSTRIAL APPLICABILITY

The arrangement of the present invention prevents hitting between the first detection member and the bolt fastener of the bolts and miniaturizes the connector receptacle and the connector.

The invention claimed is:

1. A connector assembly comprising, a connector having an inner chamber with an opening and a plurality of connector terminals disposed in the inner chamber;

a connector receptacle having a receiving hole for receiving the connector, a plurality of connector receptacle terminals disposed in the receiving hole communicating with the inner chamber and securable with bolts together with the connector terminals through the inner chamber, and a first detection member disposed between the adjacent connector receptacle terminals;

a cover for covering the opening of the chamber of the connector and having a second detection member connectable to the first detection member, wherein when the opening of the inner chamber of the connector is covered with the cover, the first detection member and the second detection member are connected to allow current flow between the connector terminals and the connector receptacle terminals screwed together, and a portion, which is most adjacent to the opening of the inner chamber, of the first detection member is positioned inwardly of the opening with respect to a surface, which is most adjacent to the opening of the inner chamber, of the connector terminals.

2. The connector assembly as claimed in claim 1, wherein the first detection member includes a first terminal connectable to the second detection member and a first housing for receiving the first terminal, and the portion, which is most adjacent to the opening of the inner chamber, of the first detection member is an end surface of the first housing.

* * * * *